US006663456B2

(12) United States Patent
Gemma, Jr.

(10) Patent No.: US 6,663,456 B2
(45) Date of Patent: Dec. 16, 2003

(54) COMBINED STORY MEDIA AND PUPPET TOY

(75) Inventor: Edward A. Gemma, Jr., Milford, CT (US)

(73) Assignee: Innovative USA, Inc., Norwalk, CT (US)

( * ) Notice: Subject to any disclaimer, the term of this patent is extended or adjusted under 35 U.S.C. 154(b) by 0 days.

(21) Appl. No.: 10/074,510

(22) Filed: Feb. 12, 2002

(65) Prior Publication Data

US 2003/0162471 A1 Aug. 28, 2003

(51) Int. Cl.[7] ..... A63H 33/00

(52) U.S. Cl. ..... 446/71; 446/147; 446/327; 446/82; 446/83

(58) Field of Search ..... 446/327, 147, 446/151, 79, 487, 478, 71–73, 75, 82, 83

(56) References Cited

U.S. PATENT DOCUMENTS

| | | | | | |
|---|---|---|---|---|---|
| 937,780 | A | * | 10/1909 | Eastman | 446/303 |
| 1,136,454 | A | * | 4/1915 | Warren | 40/539 |
| 1,273,643 | A | * | 7/1918 | Matthews | 446/366 |
| 1,405,134 | A | * | 1/1922 | Hoyme | 281/31 |
| 1,419,976 | A | * | 6/1922 | Matthews | 446/82 |
| 1,431,891 | A | * | 10/1922 | Hadley | 446/143 |
| 2,009,337 | A | * | 7/1935 | Brewer | 40/418 |
| 2,063,600 | A | * | 12/1936 | Gustafsson | 446/366 |
| 2,130,343 | A | * | 9/1938 | Havel | 446/334 |
| 2,187,407 | A | * | 1/1940 | Stone | 446/327 |
| 2,283,104 | A | * | 5/1942 | Surman | 446/83 |
| 2,307,296 | A | * | 1/1943 | Peyton | 40/411 |
| 2,367,373 | A | * | 1/1945 | Ralston | 446/151 |
| 2,620,591 | A | * | 12/1952 | Scola | 446/82 |
| 2,621,440 | A | * | 12/1952 | Stone | 446/327 |
| 2,655,762 | A | * | 10/1953 | Burke | 446/327 |
| 2,725,670 | A | * | 12/1955 | Hodes | 446/327 |
| 2,852,885 | A | * | 9/1958 | Mayer | 446/327 |
| 3,789,546 | A | * | 2/1974 | Morrison | 446/227 |
| 3,918,180 | A | | 11/1975 | Chamberlin | |
| 4,186,497 | A | * | 2/1980 | Legoria | 434/159 |
| 4,233,772 | A | | 11/1980 | Hamar | |
| 4,326,356 | A | | 4/1982 | Mason | |
| 4,341,521 | A | | 7/1982 | Solomon | |

(List continued on next page.)

FOREIGN PATENT DOCUMENTS

| | | | | | |
|---|---|---|---|---|---|
| DE | 463220 | A | * | 7/1928 | |
| EP | 0253356 | A1 | * | 1/1988 | |
| EP | 0968745 | A2 | * | 5/1999 | |
| GB | 444755 | A | * | 3/1936 | |
| GB | 2134396 | A | * | 8/1984 | A63H/33/00 |
| GB | 2320701 | A | * | 7/1998 | A63H/33/38 |
| IT | 546012 | A | * | 12/1953 | |
| JP | 09201479 | A | * | 8/1997 | A63H/33/38 |
| JP | 09225151 | A | * | 9/1997 | A63H/33/38 |
| JP | 09225152 | A | * | 9/1997 | A63H/33/38 |
| JP | 10324080 | A | * | 12/1998 | B42D/15/02 |
| WO | WO 8900877 | | * | 2/1989 | A63H/33/38 |
| WO | WO 9621498 | A1 | * | 7/1996 | A63H/3/14 |

OTHER PUBLICATIONS

Internet: http://www.funfelt.com/boards.html, Felt Board Sets for Storytelling, 2003.*

*Primary Examiner*—Derris H. Banks
*Assistant Examiner*—Urszula M Cegielnik
(74) *Attorney, Agent, or Firm*—Hedman & Costigan, P.C.; Alan B. Clement

(57) ABSTRACT

A toy comprising in combination a story media, a puppet manipulator, and puppet figures in a stage-like box. The puppet figures may represent characters objects or scenes from the story media. The puppet manipulator device is adapted to allow a user to removably attach various puppet figures to act out a play, scene or story selected from the story media using several puppet figures at the same time.

19 Claims, 5 Drawing Sheets

U.S. PATENT DOCUMENTS 4,372,077 A 2/1983 Balbuena
4,508,515 A 4/1985 Skolnick
4,555,236 A 11/1985 Peyton
4,560,359 A * 12/1985 Wilson et al. ..... 446/75
4,606,726 A 8/1986 Pash et al.
4,608,024 A 8/1986 Skolnick
4,712,673 A 12/1987 Moore
4,753,597 A 6/1988 Pash et al.
4,865,574 A * 9/1989 Kobayashi ..... 281/15.1
4,869,702 A 9/1989 Derby, III
4,874,340 A 10/1989 Smallwood
4,880,404 A 11/1989 Derby, III
5,261,849 A * 11/1993 French ..... 446/82
5,383,684 A * 1/1995 Smath ..... 281/21.1
5,389,028 A 2/1995 Cabrera et al.
5,472,364 A 12/1995 Castleman
5,522,754 A * 6/1996 Hanson ..... 40/427
5,525,088 A 6/1996 Mayne
5,653,470 A 8/1997 Bennett
5,746,637 A * 5/1998 Hunt ..... 281/29
5,827,103 A 10/1998 Carter
5,980,352 A * 11/1999 Rigberg ..... 446/82
6,506,093 B2 * 1/2003 Avital ..... 446/83

* cited by examiner

COMBINED STORY MEDIA AND PUPPET TOY

FIELD OF THE INVENTION

The present invention broadly relates to a device comprising in combination a story media, a puppet manipulator, and puppet figures contained in a stage-like box. The puppet figures may represent characters, objects or scenes relating to the story media. The puppet manipulator device is adapted to allow a user to removably attach several puppet figures to act out a play, scene or story selected from the story media.

BACKGROUND OF THE INVENTION

Devices for enhancing a child's imagination and/or desire to read are generally well known in the art. These enhancement devices take many forms and include the use of puppets. For example, Skolnick, U.S. Pat. No. 4,608,024, teaches the use of a puppet removably attached to a book cover into which a user can introduce a hand to manipulate a single puppet. Skolnick '024 further discloses that the puppet may be related to a theme of the book and may be folded in between the pages of the book when the book is closed.

Castleman, U.S. Pat. No. 5,472,364, discloses a puppet toy that comprises a book cover having a pocket therein, and a number of puppet features located on the inside surface of the pocket of the cover. The puppet toy is turned inside out to transform the book into a puppet.

Balbuena, U.S. Pat. No. 4,372,077, discloses a merchandisable packet comprising a storybook, a flannel board, flannel board figures, and a hand puppet. The flannel board figures represent characters, objects, or scenes from the storybook and the puppet is a likeness of one of the story characters. The hand puppet includes a storage pocket therein to store the storybook, flannel board and flannel board figures.

No prior art, however, teaches or suggests a device comprising a combination of a story media, a puppet manipulator, and puppet figures that can be used to represent at the same time several characters, objects or scenes selected from the story media, contained in a box which can function as a puppet stage. In this manner, the device of the present invention provides a novel and exciting way to enhance a child's imagination in the course of enjoying the story media.

SUMMARY OF THE INVENTION

The present invention concerns a device whereby a user is readily enabled to create a puppet show by acting out plays, scenes or stories from a story media, such as a book, CD-Rom, audio cassette, etc., using several puppet figures at the same time.

Thus, it is an object of the present invention to provide a useful device that will allow a user to select a story from a story media, create or select puppet figures related to the selected play, scene or story, and act out the play, scene or story using several puppet figures removably attached to a puppet manipulator.

It is further an object of the present invention to provide a combination puppet manipulator, puppet figures, story media, and a box suitable for use as a puppet stage that is self-contained and easy to use.

It is further an object of the present invention to provide a user with imaginative plays, stories and scenes to act out using puppets.

It is a further object of this invention to allow a user to develop and express his/her imagination, creativity and to develop thinking skills.

It is further an object of the present invention to provide an outlet for creative entertainment that is easy to use and relatively cost-efficient to manufacture.

These and other objects will become evident to those skilled in the art from the specification.

To this end, the present invention provides a device comprising, in combination, a box comprising an innerspace defined by a back wall, a front wall, a left side wall, a right side wall, an upper wall and a lower wall; a puppet manipulator means suitable for being located in the innerspace and accessible to a user with a puppet attachment portion; at least one puppet figure attachable to the puppet attachment portion; and a story media containing at least one story, play or scene related to at least one of the puppet figures. Preferably the front wall of the device comprises an upper portion having a window and a lower portion suitable for attaching the story media, the window being suitable for viewing at least one of the puppet figures attached to the puppet manipulator and wherein the puppet manipulator is glove-shaped.

BRIEF DESCRIPTION OF THE INVENTION

DETAILED DESCRIPTION OF THE INVENTION

Figure 1:
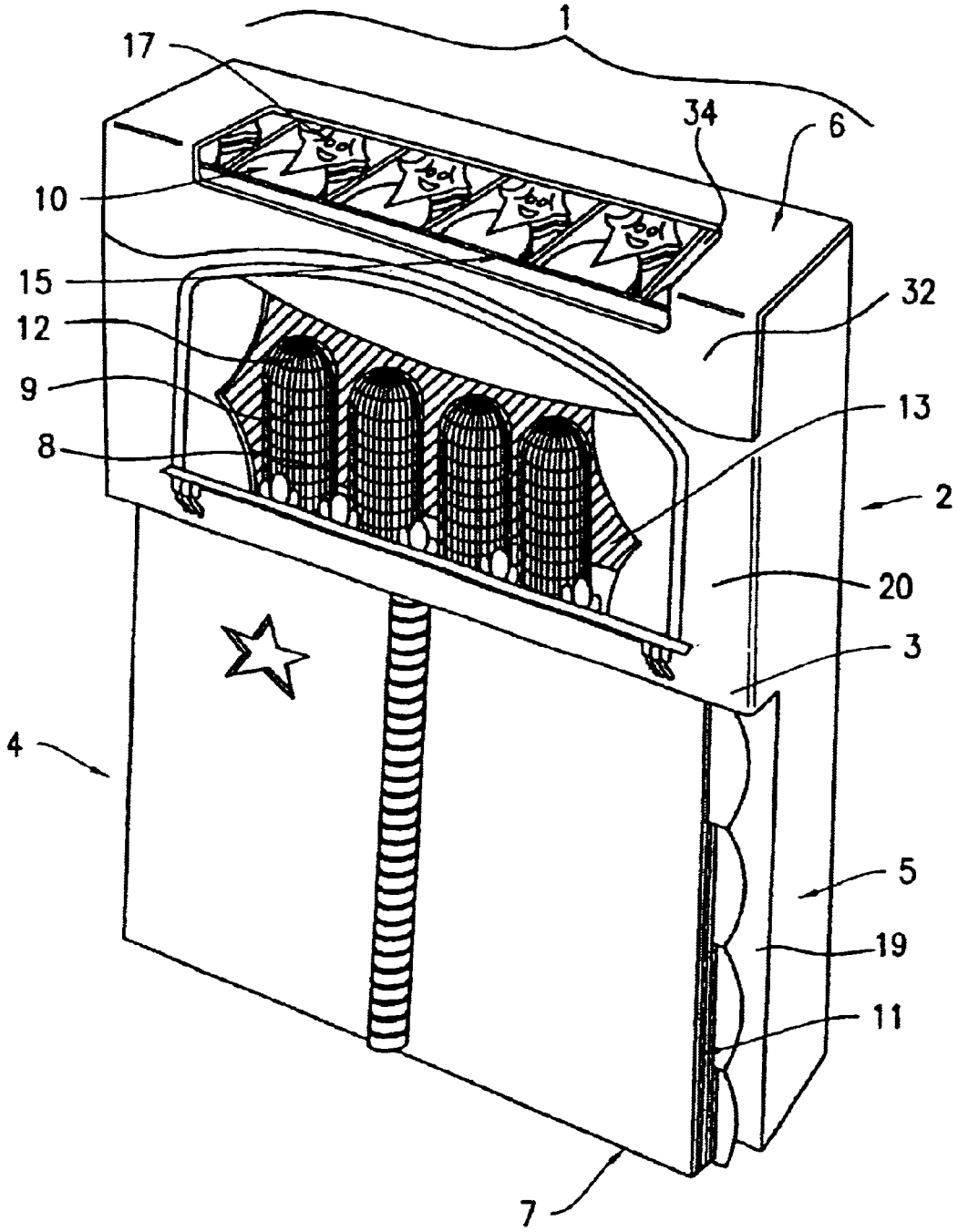
FIG. 1 is a perspective view of one preferred embodiment of the present invention depicting the box suitable for use as a puppet stage, story media, puppet figures, puppet manipulator and storage container for some or all said items of the present invention.

Referring to FIG. 1, there is shown a perspective view of an embodiment of the present invention depicting the box 1, comprised of a back wall 2, a front wall 3, a left side wall 4, a right side wall 5, a top wall 6 and a bottom wall 7. The box may be constructed of any suitable relatively rigid material such as cardboard, plastic or any other suitable material known for making boxes to those skilled in the art.

Continuing with reference to FIG. 1, the front wall 3 is comprised of a lower portion 19 and upper portion 20. The upper portion 20 is provided with a stage opening 13 through which can be seen a puppet attachment portion 9 of a puppet manipulator 8 whereon puppet figures 10 may be removably attached. In the depicted embodiment, the puppet manipulator 8 has a glove-like shape and the puppet attachment portion 9 thereof comprises four fingers portions of the glove-like shape puppet manipulator 8. In other embodiments, the manipulator need not be glove-like in shape and may take the form of movable tabs or any other method for manipulating puppets or the like known to those skilled in the art.

Also with reference to FIG. 1, the puppet manipulator 8 is affixed to the inside of the front wall 3 and back wall 2 of the box 1 and is adapted to be manipulated through an opening 16 (see FIG. 5) in the bottom wall 7 of the box. In other preferred embodiments, the puppet manipulator 8 may be removed from the box and need not be used in conjunction with the stage opening 13 of the box. In the depicted embodiment, the stage opening 13 is die cut from the upper portion 20 of the front wall. The stage opening may take any suitable shape.

The puppet manipulator depicted may be constructed of a durable cloth but may also be constructed of other suitable materials known to those skilled in the art. Especially preferred for the present embodiment is the use of a material on the puppet attachment portion(s) 9 that will allow a half side of VELCRO (fastening tape consisting of a strip of nylon with a surface of minute hooks) to facilitate the attachment of puppet figures 10 equipped on their back side with a corresponding piece of VELCRO (corresponding piece of said fastening tape) 14 (see FIG. 3). In other embodiments, the puppet manipulator may be constructed of felt to allow puppet figures 10 of, or affixed to, felt to be attached to the puppet manipulator 8. The depicted puppet manipulator 8 may be of a size and construction to accommodate various hand sizes depending on the age group to which the story media is directed.

In other embodiments, the puppet figures 10 may include peel off or other kinds of stickers or adhesives known in the art that will allow a user to attach the puppet figures 10 to the puppet attachment portion 9 of the puppet manipulator 8 with or without using glue or tape. Additionally, puppets that are shaped to fit over the finger portions of the manipulator may also be used.

In one preferred embodiment, the puppet figures 10 are uncolored/unadorned and may be colored/decorated by the children prior to use to further enhance their enjoyment of the device. In other embodiments the puppet figures 10 may be precolored. The puppet figures 10 may be constructed of paper, cardboard, plastic or any other suitable material known to those skilled in the art. The size of the puppet figures is dependent on the size of puppet manipulator 8, the number of puppets needed to act out the scene, the size of the stage opening 13 and/or the size of the compartment 15 in which they are to be stored.

In preferred embodiments, the puppet figures 10 have pictures on one side 17 (see FIG. 3) closely related to the subject matter of the story media 11, such as personifying shapes or characters in the story. The puppet figures 10 not in use may be stored or contained within a compartment 15 of the box. For instance, in embodiments where the story media 11 contains more than one scene for acting out with the puppets, or where the story media 11 contains more than one story, certain puppets may not be required at a given time and may be kept in storage for later use. In other embodiments, the user may be free to create his/her own puppet figure characters and/or write or otherwise create his/her own story. In this regard, the book 11 may be provided with blank pages. In still other embodiments, the user may dress, or attach different materials or textures to, the puppet figures.

In the depicted embodiment of FIG. 1, the story media 11 is a book attached by its back cover to the lower portion 19 of the front wall 3 of the box 1. The story media may be removably attached to the box 1 by the use of VELCRO (fastening tape consisting of a strip of nylon with a surface of minute hooks that fasten to a corresponding strip with a surface of uncut pile to stick thereto), sliding into a pocket, or any other suitable means know to those skilled in the art. Further, in order to keep the book closed during transport, a clasp or other suitable mechanism may be provided to keep the top cover and pages from flipping open. In other embodiments using a book, the book may be permanently affixed to the box 1 by glue or any other suitable binding means known to those skilled in the art. In still other embodiments, the story media may be attached elsewhere on the box or contained within a compartment 15 or elsewhere within the box 1. The story media may comprise a book, an audiotape, a videotape, a compact disk, a DVD, a diskette, or a CD Rom or any combination thereof. The story media 11 may have several plays scenes or stories therein. In other embodiments, the story media 11 may be such that it allows space for a user to create his/her own plays, scenes or stories.

Figure 2:
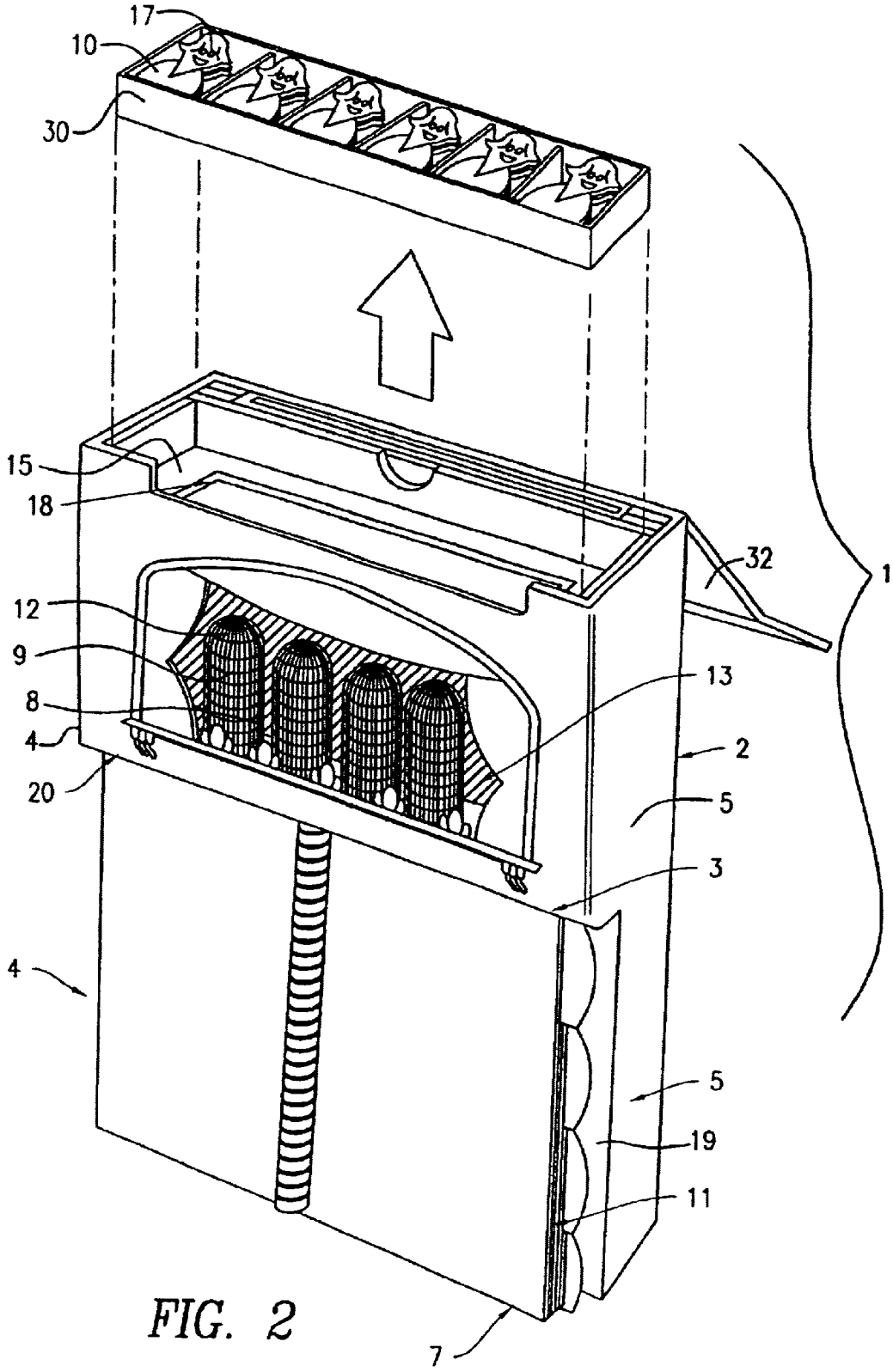
FIG. 2 is a top plan view of an embodiment of the present invention showing storage of puppets in a top portion of the box.

FIG. 2 is a top plan view of an embodiment of the present invention showing storage of puppet figures 10 in a tray 30 which fits into a compartment 15 in the top of the box 1. In the depicted embodiment, the tray 15 is removable from the box 1 but, in other embodiments, it may be permanently attached. Further, the box 1 contains a partition 18 supporting the compartment 15. Referring to FIG. 1, the box is provided with a lid that covers the puppet storage compartment and keeps the stored items from falling out of the box top. Preferably the lid 32 is provided with a see through window 34 through which a prospective purchaser can view the puppets in storage. The lid may be closed by the use of VELCRO (fastening tape consisting of a strip of nylon with a surface of minute hooks that fasten to a corresponding strip with a surface of uncut pile to stick thereto), magnetic, or friction closures, or by any other suitable means known to those skilled in the art.

Figure 3:
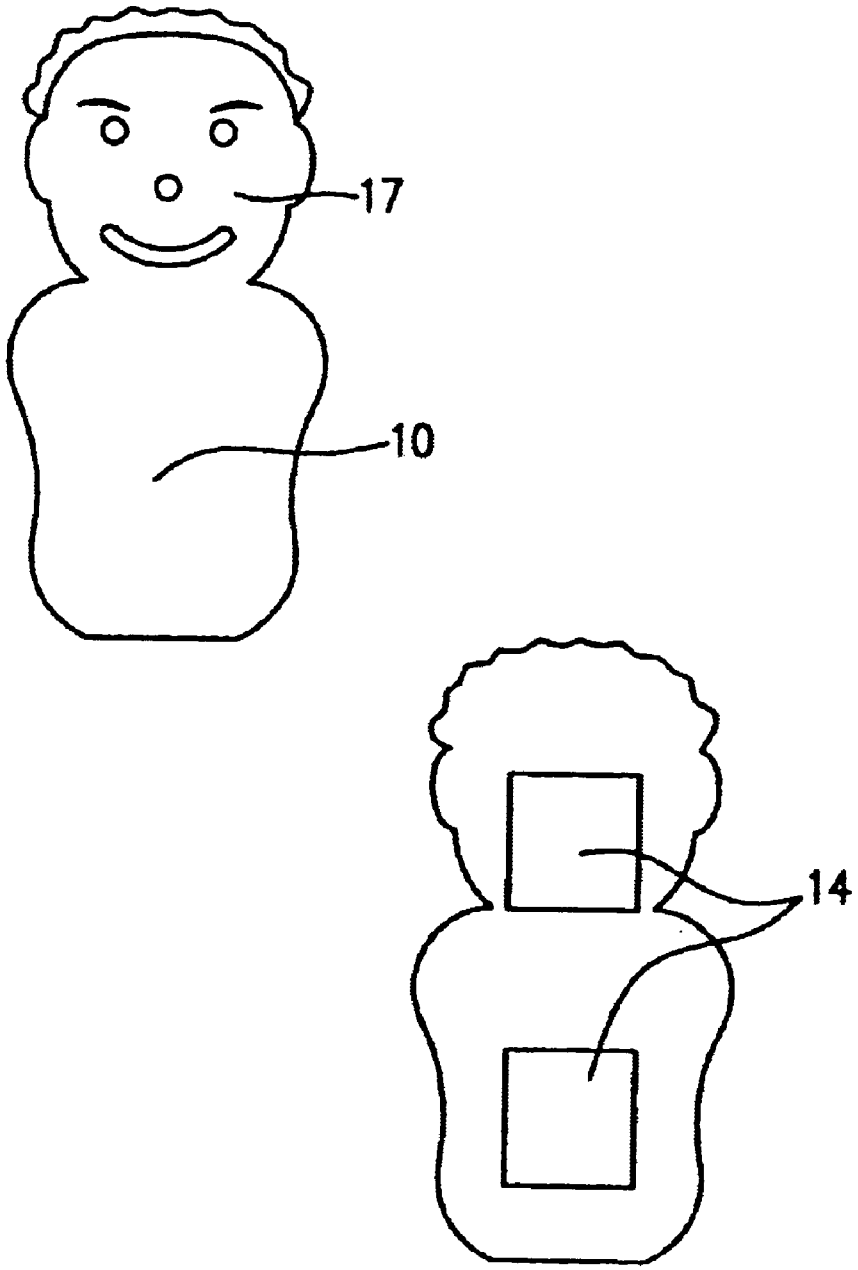
FIG. 3 are plan views of puppet figures that may be removably attached to the puppet attachment portion of the puppet manipulator for use in embodiments of the present invention.

FIG. 3 depicts one preferred embodiment of the puppet figures 10 and the means for removably attaching them to the puppet attachment portion 9 of the puppet manipulator 8. In the depicted embodiment, the puppet figures 10 are individual and pre-cut. However, in other preferred embodiments, the puppet figures 10 may be printed on a single piece of suitable material and cut out for use, thus providing another activity for the children using the book. The dimensions and construction of the puppet figures 10 may be as set forth above in the discussion of FIG. 1. Further, the puppet figures 10 may have a means for removably attaching them the puppet attachment portion 9 of the puppet manipulator 8. In the depicted embodiment, the means for removably attaching the puppet figures 12 to the puppet attachment portion 9 are pieces of VELCRO (fastening tape consisting of a strip of nylon with a surface of minute hooks that fasten to a corresponding strip with a surface of uncut pile to stick thereto) 14 affixed to the puppet figures 12 by glue or any other suitable binding means known to those skilled in the art. In other embodiments, the means for removably attaching the puppet figures 12 to the puppet attachment portion 9 of the puppet manipulator 8 may be a felt piece or any other means known to those skilled in the art. As stated above, it is further contemplated by the present invention that the puppet figures are shaped to fit over the attachment portion(s) 9.

Figure 4:
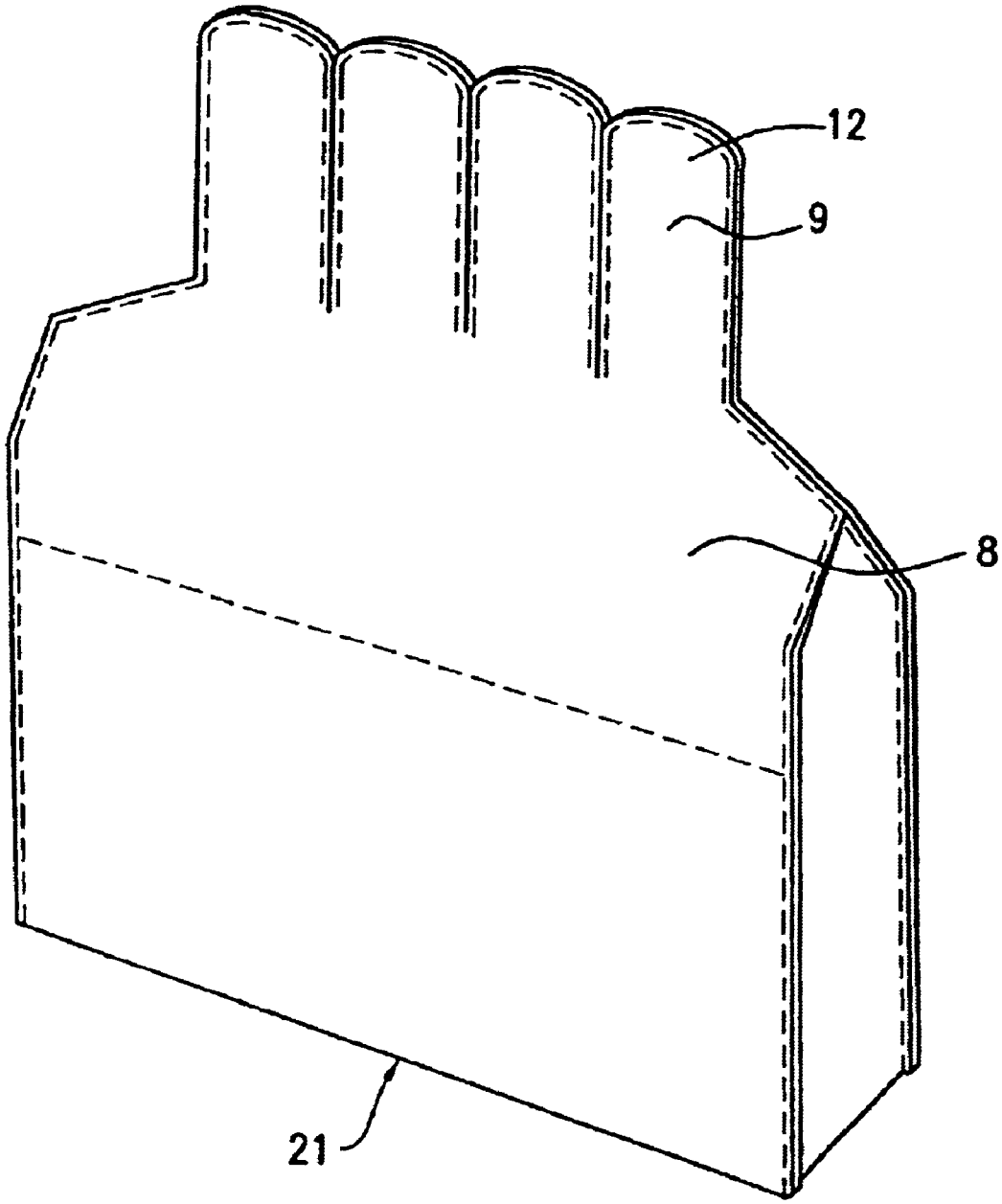
FIG. 4 is a perspective view of a glove-like puppet manipulator for use in a preferred embodiment of the present invention.

FIG. 4 depicts a puppet manipulator 8 of one preferred embodiment of the present invention. The depicted puppet manipulator is glove-like in shape with the puppet attachment portion 9 thereof comprised of four fingers of a glove (a fifth thumb portion could also be provided). The puppet manipulator is adapted to be manipulated through the insertion of a hand through a hand insertion space 21 in the bottom of the puppet manipulator. In other embodiments, the manipulator need not be glove-like and may take the form of movable tabs, marionette-like controls or any other method for manipulating puppets or the like known to those skilled in the art. The dimensions and construction of the puppet manipulator 8 may be as set forth above in the discussion of FIG. 1.

Figure 5:
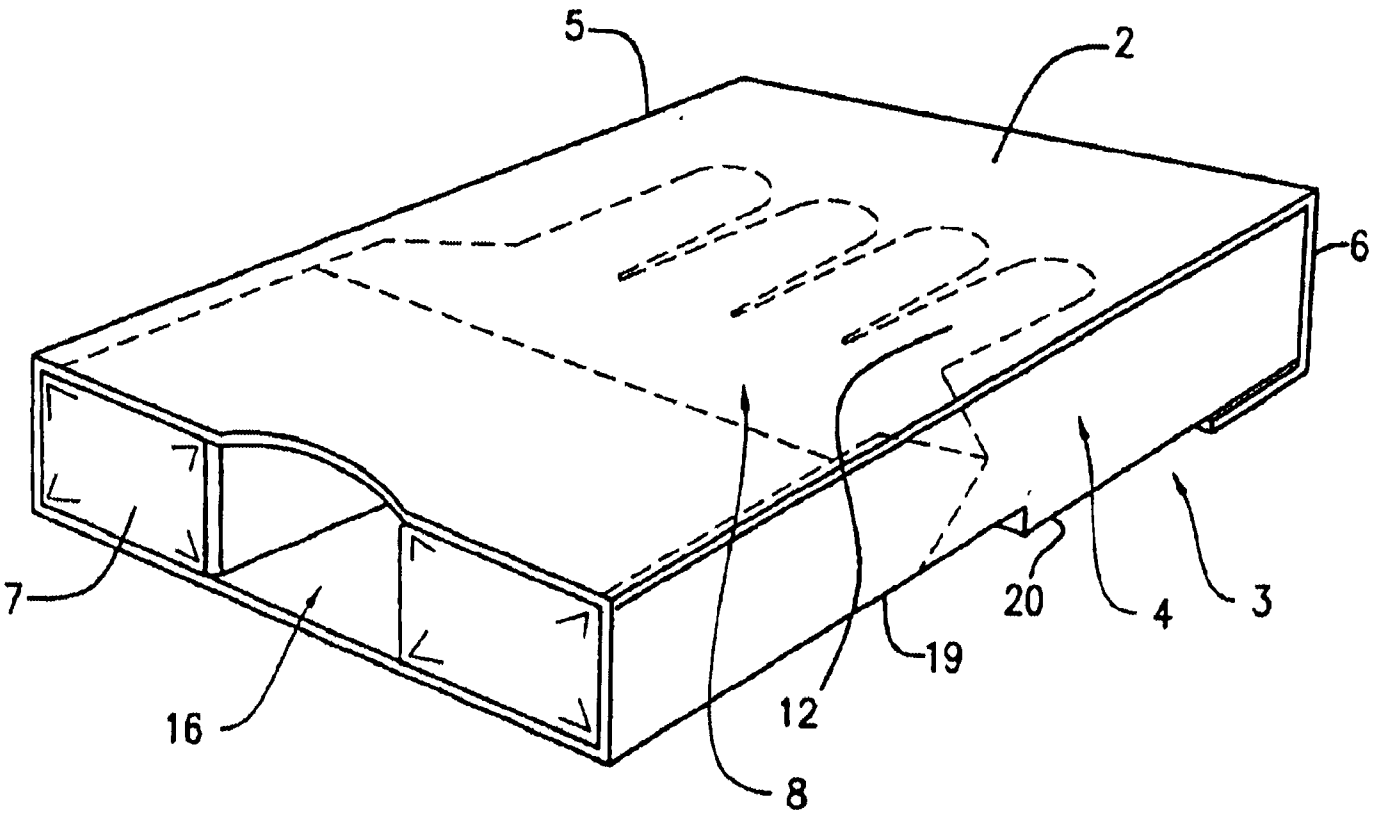
FIG. 5 depicts the manner in which a glove-like puppet manipulator is contained within the box in a preferred embodiment of the present invention.

With reference to FIG. 5, the depicted puppet manipulator 8 is contained within the box 1 and is adapted to be manipulated through an opening 16 in the bottom wall 7 of the box. In other preferred embodiments, the puppet manipulator may be removed from the box and need not be viewed through the stage opening 13.

Thus, in one embodiment of operation of the device of the present invention, the child reads the story and can act out a scene from the story, by attaching puppets to the puppet manipulator and inserting his or her hand into the manipulator. At the end of the scene, new characters may be added, and/or other characters removed depending on the characters involved in the next scene of the story or play. Alternatively, if the story only encompassed one scene, then, an entire new set of characters of a new story can be employed.

The above-mentioned patents are incorporated herein by reference. Many variations of the present invention will suggest themselves to these skilled in the art in light of the above-detailed description. All such obvious variations are within the full intended scope of this appended claims.

I claim:

1. A device comprising, in combination:

a box comprising an inner space defined by a back wall, a front wall, a left side wall, a right side wall, an upper wall and a bottom wall;

a puppet manipulator suitable for being located in said interior space and accessible to a user with a puppet attachment portion;

at least one puppet figure attachable to said puppet attachment portion;

a story media containing at least one story, play or scene related to said at least one puppet figure;

wherein said story media is selected from the group consisting of a book, an audiotape, a videotape, a DVD, a diskette, a CD-Rom, and combinations of any of the foregoing; and wherein said puppet attachment portion of the puppet manipulator is comprised of a cloth material.

2. A device comprising, in combination:

a box comprising an inner space defined by a back wall, a front wall, a left side wall, a right side wall, an upper wall and a bottom wall;

a puppet manipulator suitable for being located in said interior space and accessible to a user with a puppet attachment portion;

at least one puppet figure attachable to said puppet attachment portion;

a story media containing at least one story, play or scene related to said at least one puppet figure;

wherein said story media is selected from the group consisting of a book, an audiotape, a videotape, a DVD, a diskette, a CD-Rom and combinations of any of the foregoing; and wherein said puppet manipulator is glove-shaped and at least one finger portion of said glove-shaped puppet manipulator comprises a puppet attachment portion.

3. A device as defined in claim 2 wherein at least four fingers of said glove-shaped puppet manipulator comprise puppet attachment portions.

4. A device comprising, in combination:

a box comprising an inner space defined by a back wall, a front wall, a left side wall, a right side wall, an upper wall and a bottom wall;

a puppet manipulator suitable for being located in said interior space and accessible to a user with a puppet attachment portion;

at least one puppet figure attachable to said puppet attachment portion;

a story media containing at least one story, play or scene related to said at least one puppet figure;

wherein said story media is selected from the group consisting of a book, an audiotape, a videotape, a DVD, a diskette, a CD-Rom and combinations of any of the foregoing; and wherein at least one portion of said puppet manipulator is affixed to the inside of one of the box walls.

5. A device as defined in claim 1 wherein at least one wall of said box contains a stage opening adapted to allow the user or another person to view the puppet figures attached to the puppet attachment portion of the puppet manipulator.

6. A device as defined in claim 1 wherein at least one of said puppet figures is removably attached to said puppet attachment portion.

7. A device as defined in claim 6 wherein the said puppet figure(s) comprise a portion made of fastening tape consisting of a strip of nylon with a surface of minute hooks that fasten to a corresponding strip with a surface of uncut pile to stick thereto of removable attachment to said puppet attachment portion.

8. A device as defined in claim 1 where the story media comprises a book.

9. A device as defined in claim 8 wherein said book is attached to the outside of said box.

10. A device as defined in claim 1 wherein said story media is removably attached to the outside of said box.

11. A device as defined in claim 10 wherein the means for removably attaching the story media to the outside of said box comprises fastening tape consisting of a strip of nylon with a surface of minute hooks that fasten to a corresponding strip with a surface of uncut pile to stick thereto.

12. A device as defined in claim 1 wherein said box further comprises at least one compartment for storing said story media, puppet figures or puppet manipulator.

13. A device as defined in claim 1 wherein said box further comprises a compartment for storing said puppet figures.

14. A device as defined in claim 5 wherein said puppet manipulator is accessible through said bottom wall and said stage opening is in an upper portion of said front wall.

15. A device as defined in claim 13 wherein said compartment for storing said puppet figures is accessible through said upper wall.

16. A device as defined in claim 14 wherein said story media comprises a book and wherein said book is attached to a lower portion of said stage opening.

17. A device comprising, in combination:

a) a box comprising inner space defined by a back wall, a front wall, a left side wall, a right side wall, an upper wall and a lower wall;

b) a puppet manipulator suitable for being located in said interior space and accessible to a user;

c) at least one puppet figure attachable to said puppet attachment portion; and d) a book containing at least one story, play or scene related to said at least one story, play or scene related to said at least one puppet figure; wherein said front wall comprises an upper portion having a window therein and a lower portion suitable for attaching said book, said window being suitable for viewing said at least one puppet figure attached to said puppet manipulator;

said book is attached to said lower portion of said front wall;

at least a portion of said puppet manipulator is affixed to the inside of the back wall of said box;

said puppet manipulator is glove-shaped and at least one finger portion of said glove-shaped puppet manipulator is comprised of a cloth material, and said glove-shaped puppet manipulator is accessible by an opening 16 in the lower wall of said box; and said at least one puppet figure comprises a back side comprising an attachment means of fastening tape consisting of a strip of nylon with a surface of minute hooks for attaching to the cloth material of said at least one finger portion of said glove-shaped puppet manipulator, and a front side comprising a likeness of a character in said book.

18. A device as defined in claim 17 further comprising a puppet figure compartment defined by said front wall, back wall, right side wall, left side wall, upper wall and an inner partition wall located above said front wall window.

19. A device as defined in claim 18 wherein:

said book comprises a first story, play or scene having at least four characters and a second story, play or scene having at least four characters;

said puppet figure compartment contains a first set of four puppets each said puppet in the first set of puppets related to each of the four characters in said first story, play or scene, and a second set of puppets each said puppet in the second set of puppets related to each of the four characters in said second story, play or scene;

said glove-shaped puppet manipulator comprises four finger portions comprised of a cloth material;

each said puppet having a back side comprising an attachment means of fastening tape consisting of a strip of nylon with a surface of minute hooks for attaching to the cloth material of a finger portion of said glove-shaped puppet manipulator; whereby while a user of the device views the first story, play or scene of said book the user can attach each of four puppets of said first set of puppets to said finger portions of said glove-shaped puppet manipulator and manipulate the puppets to act out at least a portion of said first story, play or scene; and upon completion of said first story, play or scene, said user can remove each of said four puppets from said finger portions of said glove-shaped puppet manipulator, attach each of the four puppets of said second set of puppets to said finger portions of said glove-shaped puppet manipulator and manipulate the puppets to act out at least a portion of said second story, play or scene.

* * * * *